US005609937A

United States Patent [19]

Reinstad

[11] Patent Number: 5,609,937

[45] Date of Patent: Mar. 11, 1997

[54] FRAME FOR ATTACHMENT TO AIR FILTERS

[75] Inventor: Dennis O. Reinstad, Stoughton, Wis.

[73] Assignee: Research Products Corporation, Madison, Wis.

[21] Appl. No.: 287,876

[22] Filed: Aug. 9, 1994

[51] Int. Cl.[6] ..... A47G 1/12

[52] U.S. Cl. ..... 428/122; 29/432; 55/DIG. 31; 428/358

[58] Field of Search ..... 428/122, 358; 29/432; 55/DIG. 31

[56] References Cited

U.S. PATENT DOCUMENTS

| | | | |
|---|---|---|---|
| 911,195 | 2/1909 | Baker | 403/402 |
| 1,587,690 | 6/1926 | Wenn | 29/505 |
| 1,600,570 | 9/1926 | Wenn | 29/505 |
| 1,867,175 | 7/1932 | Reid | 428/122 |
| 2,126,544 | 8/1938 | Everhard | 52/658 |
| 2,159,355 | 5/1939 | Goetze | 428/122 |
| 2,225,592 | 12/1940 | MacFadden | 248/500 |
| 3,168,917 | 2/1965 | Bartels | 428/122 X |
| 3,630,007 | 12/1971 | Neuman | 96/129 |
| 3,670,399 | 6/1972 | George | 428/31 X |
| 4,262,810 | 4/1981 | Ilich | 211/206 |
| 4,343,135 | 8/1982 | Ilich | 53/444 |
| 4,584,005 | 4/1986 | Allan et al. | 55/DIG. 31 |
| 5,304,412 | 4/1994 | Wang | 428/542.2 X |

*Primary Examiner*—Henry F. Epstein
*Attorney, Agent, or Firm*—Andrus, Sceales, Starke & Sawall

[57] ABSTRACT

A frame for a panel-like filter having two sides terminating in an edge comprises a semi-resilient deformable channel having an inwardly curved web with two flanges extending from a convex side thereof. The curved web also has a longitudinally extending stiffening rib projecting from the convex side thereof. The flanges are engageable with the sides of the filter.

6 Claims, 2 Drawing Sheets

FRAME FOR ATTACHMENT TO AIR FILTERS

TECHNICAL FIELD AND BACKGROUND OF THE INVENTION

The present invention relates to frames or holding devices for air filter media or the like, and a method of attaching a frame-like holding device to an article such as an air filter pad.

Although, as will become apparent as this specification proceeds, the frame or holding device of this invention has many useful applications, in the interest of clarity and by way of example, it will be described as used with air filters to provide frames for air filter units.

The principal object of the invention is to provide a framing or holding member which can be readily and firmly mounted upon a panel-like object, such as an air filter body or media, as a frame or holder therefor, and to provide a novel method of securing a firm, resilient grip of the frame upon such object.

Room and window ventilators and air conditioners and ducts or filter cells in which air filters are located provide for filter units of many different sizes. For a dealer to stock all of the different sizes and types of air filters requires a very substantial investment for inventory and a large storage area in which to keep that inventory.

As applied to air filters, an important objective of the invention is to enable the dealer to quickly and easily produce an air filter of a required size and type in his own place of business with relatively simple and inexpensive equipment. Thus, the only inventory that the dealer need maintain is a stock of the various types of panel filtering media that might be desired, and a supply of the frame stock from which the frames can be made to protect the edges of the media panels during handling and cleaning, facilitate installation and removal, improve the air seal at the edges of the unit, and generally to improve the appearance of the filter and prolong its life. When an order is received for a filter of a particular size and containing a specified type of filter material, the dealer can cut the filter pad to size from stock and form a frame of the required dimensions for holding the filter media.

In forming a frame for a filter pad, or in forming a holding device for other objects, one of the desirable attributes is that the frame fit snugly upon the filter pad or object, and securely engage the same to prevent their undesired separation when in use. When sheet material of the type that might be used in a filter frame, for example, is bent, even beyond the elastic limit of the material, there is some residual resiliency in the metal at the bend which acts, after the bending pressure is removed, to return the bent portions to some extent towards their original positions before bending. In other words, while, in the main, the elastic limit of the material is exceeded during the course of the bending operation so that to some extent the bend will remain after the bending pressure is removed, to some extent there is some residual elasticity producing some recovery. This recovery will normally cause the frame to grip the filter pad less tightly than it did while the bending pressure was applied, so that the frame and pad may not be securely engaged. Furthermore, this recovery and release may result in an unsightly appearance of the completed filter.

The usual method for providing a holding member is to form a channel having two flanges connected by a web. This channel is then placed along an edge of the object on which it is to be mounted with the flanges extending over the edge areas of the sides of the object. The two flanges are bent toward each other to grasp the object. Assuming the material used to have some elasticity, there would be some recovery movement of the flanges when the bending pressure is removed which would cause the flanges to spread apart and separate somewhat from the object. Even though this residual elasticity may be relatively small, it may be undesirable in many applications.

This drawback is rectified in U.S. Pat. No. 3,168,917 issued Feb. 9, 1965 and assigned to the assignee of the present application. In this device, in addition to applying pressure to the outer faces of the two flanges to bend them toward each other, pressure also is applied to the web to force curvature of the web with the convex side of the curvature facing the same direction as that in which the flanges extend from the web. This, of course, makes the outer face of the web concave. When the pressures on the flanges and web are removed, the residual resiliency at the lines of juncture of the flanges and the web tends to cause the flanges to move outwardly from the object as in the prior art method above described. At the same time, the residual resiliency in the bent web acts to cause the web to tend to flatten or decrease in curvature to some extent. To the extent that the web flattens, or decreases in curvature, the two flanges of the channel will tend to be turned against the object.

Thus, the residual resiliency at the bend of the channels tends to cause a movement of the channels in one direction while the residual resiliency in the web tends to move the flanges in the opposite direction. By controlling the extent of movement of the pressure applying means, the two residual resiliency movements upon the removal of the pressures may be made to substantially offset each other, or one may be made greater than the other. This enables the process of the invention to be used to hold the exact position of the flanges with respect to the object upon the removal of the pressures, or, in fact, to press the flanges against the objects to a somewhat greater extent upon the removal of the pressures than was the case at the time the pressures were being applied.

To simplify the equipment needed for general applications of the method of the invention, the web of the channel may be pre-bent before the channel is positioned on the object on which it is to be mounted. Thus, in the preferred method, the web of the channel is preformed so that the face of the web on the side toward which the flanges project is convex and the opposite face is concave. At the same time, the channel is formed with each flange forming an acute angle with the web. The thus preformed channel is then slipped onto the object on which it is to be mounted in the same manner as previously described. Pressure then is applied to the outer faces of the two flanges, with the pressure being so applied as to have two effects. First, the pressure bends the flanges against the object on which it is to be secured and, secondly, the pressure increases the curvature of the web. When the pressure is relieved, the two results above described occur, namely, the resiliency at the bends between the flanges and the web tends to cause the other portions of the flanges to move apart and the resiliency in the web tends to cause the outer portions of the two flanges to move together. The extent to which these will offset each other upon the removal of the pressure can be determined by controlling the extent to which the web is deflected, i.e. increased in curvature, at the time the pressure is applied to the two outer faces of the flanges.

In another practice of the method, the web of the channel is not preformed but may be straight as in prior art procedures. As forming pressure is applied to the flanges to bend them against the object to be gripped, pressure is also applied to the outer face of the web to deflect it towards the edge of the object. The important consideration is to make sure that the curvature forced in the web by the forming pressure is in the right direction, since curvature in the wrong direction would result in adding to the outward movement of the flanges upon removal of the forming pressure rather than nullifying this movement. Thus, when forming pressures are relieved, the same two effects occur, namely, an offsetting of the tendency of the edges of the flanges to turn away from each other with the tendency of them to turn toward each other because of the recovery of the deflected web.

While the '917 patent has been generally successful in securing an object such as a filter pad within a frame, it has been found that occasionally the curved web will "pop out" or assume a reverse curvature which results in a loosening of the grip of the flanges upon the filter pad. Accordingly, it is desirable to provide a frame which is effective to ensure a secure bite on a filter pad. It is also highly desirable that such frame be economical and be tightly attached to a filter pad or the like.

SUMMARY OF THE INVENTION

The improved frame of the present invention advantageously provides positive, reliable and attractive securement for filter pads and the like. The frame has a unique construction designed for strength, durability and easy installation upon a variety of filter-like members.

These and other aspects of the invention are realized in a frame for a panel-like filter having two sides terminating in an edge. The frame comprises: a semi-resilient, deformable channel having an inwardly curved web with two flanges extending from a convex side thereof. The curved web has at least one longitudinally extending stiffening rib projecting from a surface of the web, whereby the flanges are engageable with the sides of the filter.

In another aspect of the invention, a frame has a filter having two sides terminating in an edge comprising: a semi-resilient, deformable channel having an inwardly curved web with two flanges extending from a convex side thereof. The curved web has a longitudinally extending stiffening means projecting from the surface of the web for preventing said inwardly curved web from assuming an outwardly curved configuration.

In another aspect of the invention, a method of mounting a holding member on an object having two sides terminating in an edge comprise the steps of forming a semi-resilient, readily deformable material into a channel having a curved web with two flanges extending from a convex side thereof, the curved web having a longitudinally extending rib projecting from the web; positioning the channel on the object with the two flanges extending over the edge areas of the two sides, respectively; applying pressure to the two outer surfaces of the two flanges to permanently bend the flanges to a desired position in relation to the sides and simultaneously flexing the web inwardly such that the rib engages the edge of the object; and thereafter releasing the pressure to permit the web to unflex and thereby urge the flanges together.

In yet another aspect of the invention, a method of making a framed, panel-like air filter comprises the steps of preforming from a semi-resilient, deformable material a framing channel having an inwardly curved web with two flanges extending divergently from a convex side thereof and forming acute angles with the web, the web having a longitudinally extending rib projecting inwardly from the web thereof; applying the channel around the periphery of the filter; applying pressure inwardly against the flanges of the channel to concurrently force the flanges toward the filter and flex the web inwardly and cause the rib to engage the edge of the filter; and thereafter relieving the pressure to permit the web to unflex and thereby urge the flanges into resilient clamping engagement with the filter.

In yet another aspect of the invention, a method of mounting a channel in semi-resilient, readily deformable material having a web with a longitudinally extending rib and two flanges extending therefrom onto an object having two sides terminating in an edge, comprises the steps of: positioning the channel on the object with the web extending along, and the rib extending into the edge and the two flanges extending over the edge areas of the two sides, respectively; applying pressure to the outer surfaces of the two flanges to bend the flanges inwardly with permanent deformation of the material substantially to a desired position in relation to said side of the object and at the same time to flex the web and the rib inwardly in the direction of the edge; and thereafter releasing the pressure to permit the rib to unflex and urge the flanges towards each other.

DETAILED DESCRIPTION OF THE PREFERRED EMBODIMENTS

Figure 1:
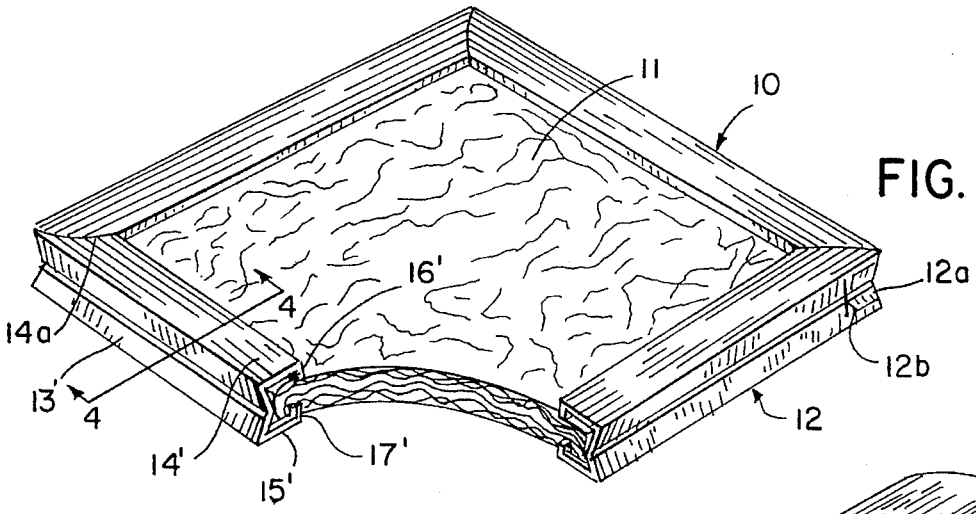
FIG. 1 is a perspective view of a filter formed in accordance with the invention with a corner thereof broken away.

FIG. 1 illustrates a filter embodying, and produced in accordance with, the invention. It comprises a frame generally indicated at 10 holding a filter body 11. The filter body may be any one of a number of types. For example, it might be an impingement type filter comprised of a plurality of superposed expanded metal foil sheets with an adhesive or sticky material thereon, a fiberglass pad, or it might be a strainer type of filter.

Figure 2:
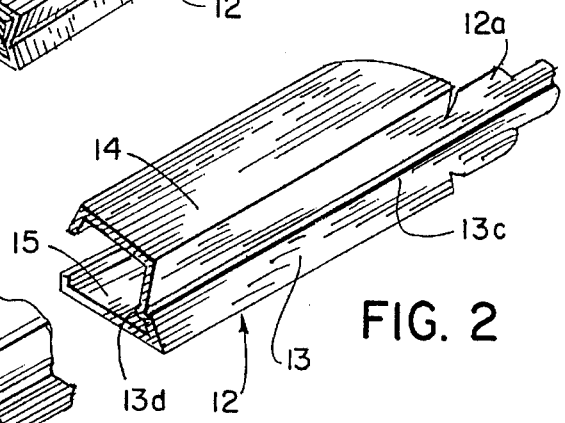
FIG. 2 is a perspective view of a length of framing channel prepared for use in forming a frame for an air filter.

Frame 10 is formed from a series of adjacently disposed channels, one of which is illustrated in FIG. 2. Channel 12 has a web 13 from which a pair of flanges 14 and 15 project. Each of the flanges 14 and 15 terminate in complementary curved end portions 14*a* and 15*a* (only one of which is shown) which fit tightly against an adjacently disposed channel 12. In addition, one end of channel 12 is provided with a bendable tongue 12*a* deformable into an aperture 12*b* on an adjacently disposed channel 12 to lock channels 12 around the periphery of filter body 11. Subflanges 16 and 17 extend inwardly from the edges of the flanges 14 and 15, respectively. Subflanges 16 and 17 form engaging means so as to securely connect the frame 10 with the pad 11 as hereinafter described. Alternative means, such as spaced prongs, may be used in place of the continuous subflanges.

Figure 3:
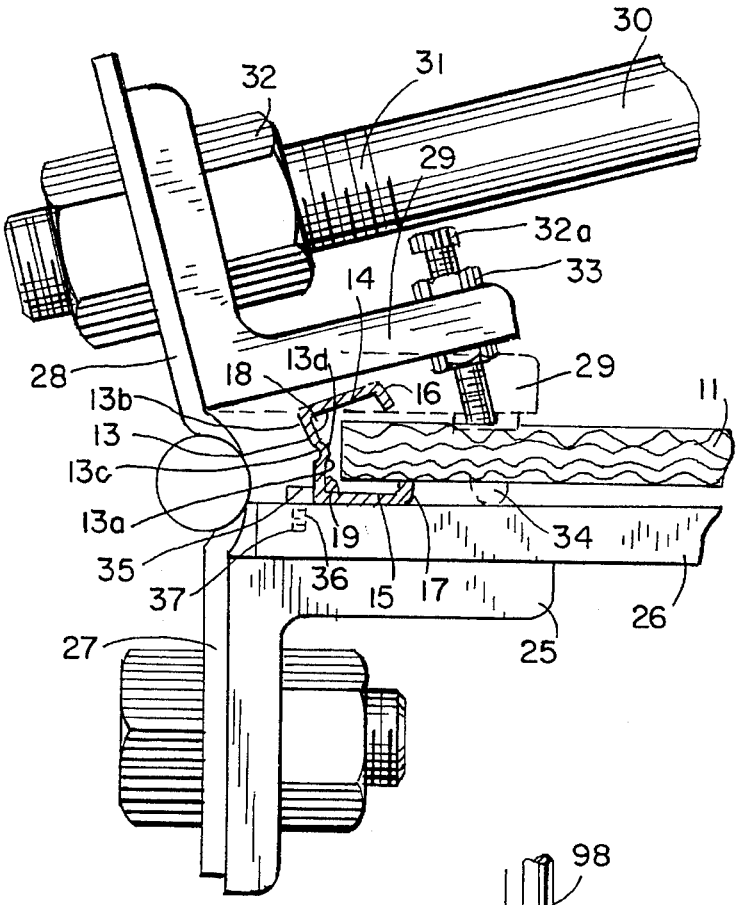
FIG. 3 is an elevational view of a portion of simple apparatus such as might be used in the forming of a frame and application thereof to a filter, and illustrates in section a portion of the filter pad and frame.

The cross-sectional shape of the channel 12 as it is preformed as a new article of manufacture to be stocked along with filtering material and before it is attached to the filter body of filter 11 is best seen in FIG. 3. The web 13 is bent so that the side 13*a* thereof, the side of the web from which the flanges 14 and 15 project, is convex while the outer face 13*b* of the web 13 is concave. The internal angle 18 between the flange 14 and the web 13 is an acute angle as is the internal angle 19 between the flange 15 and the web 13. A channel of such shape may be formed from sheet metal.

As a salient feature of the invention, the outer face 13*b* of the web 13 is scored at 13*c* to produce a longitudinally extending stiffening rib 13*d* projecting centrally from the convex side 13*a* against filter 11 for a purpose to be appreciated hereafter.

With the preformed channel 12, the next step is to apply pressure to the outer faces of the two flanges 14 and 15 to securely affix the filter body with the frame 10.

A simple apparatus for applying the required pressure to the channel is illustrated by way of example in FIG. 3. It comprises a base formed of a metal angle 25 welded to a metal base plate 26. One leaf 27 of each of a pair of ordinary loose pin hinges is welded or otherwise suitably attached to angle 25. The other leaf 28 of each hinge is attached to an angle 29 by the threaded ends of handle 30 which may generally be U-shaped for convenient operation. The two threaded ends 31 of the U-shaped handle project through suitable openings in leaf 28 and angle 29. Nuts 32 received on the threads clamp the two parts together. Adjacent the other end of angle 29 is an adjustable stop provided by a bolt 32*a* threaded through the angle 29 and fixed in place by stop nuts 33. The bottom 34 of bolt 32 is positioned to contact plate 26 and limit the downward pivotal movement of the bolt 32*a* and, thus, angle iron 29. A positioning stop 35 having pins 36 may be advantageously utilized. A plurality of openings 37 are provided in base plate 26 to receive pins 36. Openings 37 may be drilled at various distances from the hinges so that the position of stop 35 with respect to the pivotal axis of the hinges may be varied. These adjustments will permit some variation to be made in the pressure applied to the web of the framing channel.

The apparatus of FIG. 3 is utilized to apply frame-forming pressure to the channel 12. The intended frame with the filter body 11 therein is positioned on base plate 26 with the back or web of the channel abutting stop 35. Handle 30 is brought downward manually until the bottom 34 of bolt 32 contacts plate 26 as illustrated in dotted lines in FIG. 3. The bottom of angle 29, of course, presses against the outer face of flange 14. A corresponding reaction pressure is applied to flange 15 as it is pressed against base plate 26.

Figure 4A:
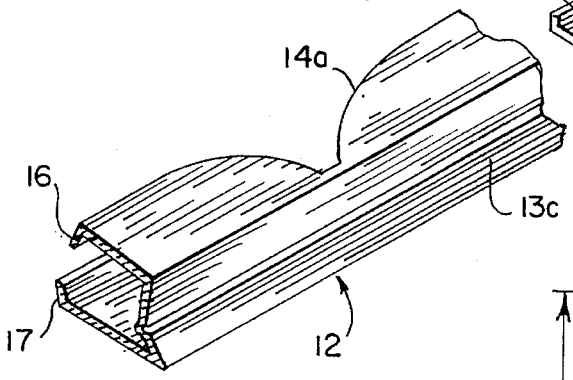
FIG. 4*a* is a cross-sectional view of the frame showing initial and final configurations and the intermediate position of the frame while under pressure externally applied in the process of applying the frame to the filter media.
Figure 4A:
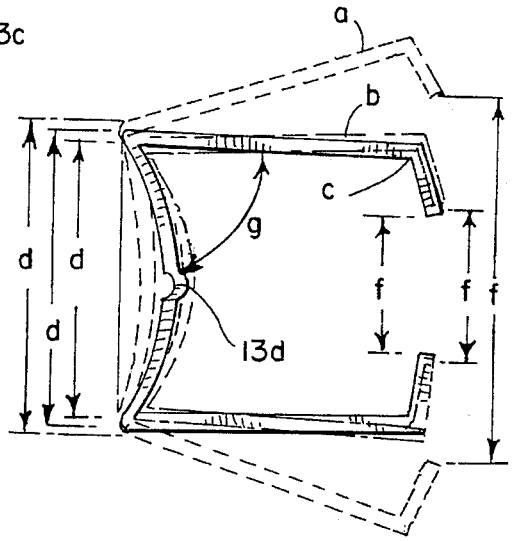
Figure 4:
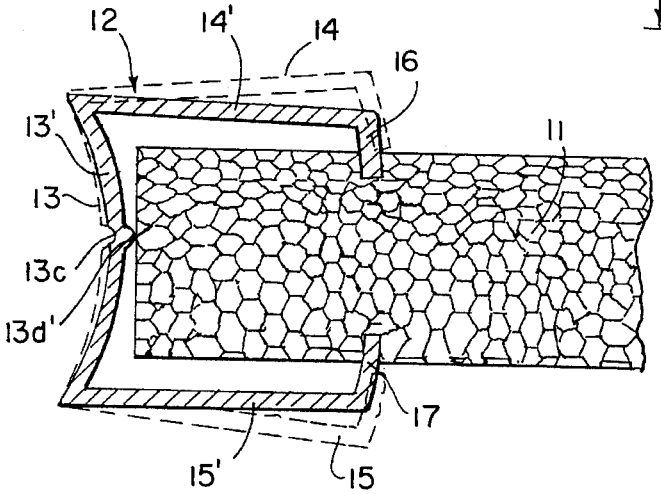
FIG. 4 is a partial section as viewed along line 4—4 of FIG. 1.

The effect of this pressure is illustrated in FIG. 4. The shape of the channel 12 before pressure is applied is illustrated in dotted lines in FIG. 4, or, as will be explained with reference to FIG. 4*a*. The application of the pressure bends the channel into approximately the shape illustrated in full lines, or, as will be explained with reference to FIG. 4*a*, slightly beyond the position shown. Thus, the two flanges 14 and 15 move to the position illustrated at 14' and 15', subflanges 16 and 17 moving to the position illustrated at 16' and 17', at which position they may dig into the filter body 11, as illustrated, to engage it. The curvature of the web 13 is increased so that the web moves approximately to the 13' position and stiffening rib 13*d* moves to the 13*d'* position approaching the edge of the filter 11.

It should be noted that stock channel 12 is formed with the flanges diverging sufficiently to permit easy insertion of the filter pad 11. When the frame forming pressure is applied to mount the frame upon the filter, the flanges are forced together to engage the filter pad, as described, this movement necessarily being sufficient to exceed the elastic limit of the material at the junctures of the flanges with the web, whereby permanent deformation is effected to decrease the internal angles between flanges and web. The movement of the pressure faces of the machine of FIG. 3 may or may not be sufficient to permanently deform the web to permanently increase the curvature thereof, but normally the web would be bent somewhat beyond the elastic limit of the material.

When the pressure on handle 30 is removed, the resiliency of the material at the bends between the flanges 14' and 15' and the web 13' tends to cause the two legs to move away from each other a short distance towards the dashed line position as shown in FIG. 4. By leg is meant the flange and subflange thereof. At the same time the resiliency of the web 13' is acting to return the web 13' toward, if not to, the dashed line position 13. This movement of the web resulting from the residual resiliency therein will pivot the flanges 14' and 15' and subflanges 16' and 17' towards each other. Thus, there are two movements caused by residual resiliencies, which two movements are the reverse of each other. The extent to which they offset each other can be controlled within limits by the amount of deflection, or increase in curvature, that is given to the web by the applied pressure and will also depend to some extent on the physical properties of the material of which the channel is made.

A more detailed analysis of what is occurring in the channel as the frame forming pressure is first applied and then released is indicated in FIG. 4*a*. The configuration of the channel is shown in three sequence positions, dashed lines a illustrating the initial form of the channel, solid lines c illustrating the final form of the frame section, and dot-dash lines b illustrating the strained form of the channel while held under pressure by the frame-mounting machine. It will be noted that the application of the forming pressure to the flanges of the channel reduces the dimension d from an initial maximum to the minimum, increases the dimension e from an initial minimum to the maximum, and reduces the distance f to an intermediate value. At the same time, the web-flange angle g, initially preferably slightly less than 90 degrees, is substantially and permanently reduced. Then, when the frame-forming pressure is relieved, the concave web springs back toward its initial position, decreasing distance e and increasing distance d to intermediate values, while the dimension f is still further reduced to the minimum distance. Thus in the final form of the frame, the gripping channel flange edges are even closer together than while held under pressure, assuring the desirable tight clamping action of the frame.

According to U.S. Pat. No. 3,168,917, with initial movement of the pressure faces of the machine after contact with the channel, the outer edge portions of the flanges are moved toward each other. Unless pressure is concurrently applied to the portions of the flanges adjacent the web, this movement will, cause the curved web to flatten somewhat and, if the initial angle of divergence of the channels were excessive, it is possible that the web would not only flatten but actually deflect with a reverse curvature. If this were to happen, ultimate release of the forming pressure would result in a loosening of the grip of the flanges upon the filter pad even greater than that resulting from recovery at the bends of the flanges. To prevent this action, as well as for other reasons, the divergence of the flanges in the preformed channel is minimized and the curvature initially formed in the web is made sufficient to form internal angles with the flanges of less than 90 degrees.

However, notwithstanding these precautions, the curved web sometimes "pops-out" or assumes a reverse, outwardly curved configuration which lessens the grip of the flanges 14 and 15 on filter 11. With the provision of stiffening rib 13*d*, reversal of the curvature of the web is avoided, it being contemplated that the flanges of the channel will normally be approximately parallel or, in any event, not bent very much beyond the parallel position. Thus, during the final movement of the pressure faces of the machine, the inward curvature of the web is increased over that of the stock channel and the bending of the junctures of the flanges and web is sufficiently severe to permanently deform the metal and bring the flange permanently closer together in snug relationship with the filter. The result following release of the forming pressure is as above described.

Substantially any of the materials commonly used for such frames or supports can be employed in connection with my invention. For example, black iron, galvanized iron, mild steel, aluminum alloy such as utility sheet, certain magnesium alloys, or copper, are eminently suitable. The invention may be employed utilizing other materials such as plastics. Materials of the type illustrated that are suitable for use in the invention are described as semi-resilient, readily deformable materials.

Figure 5:
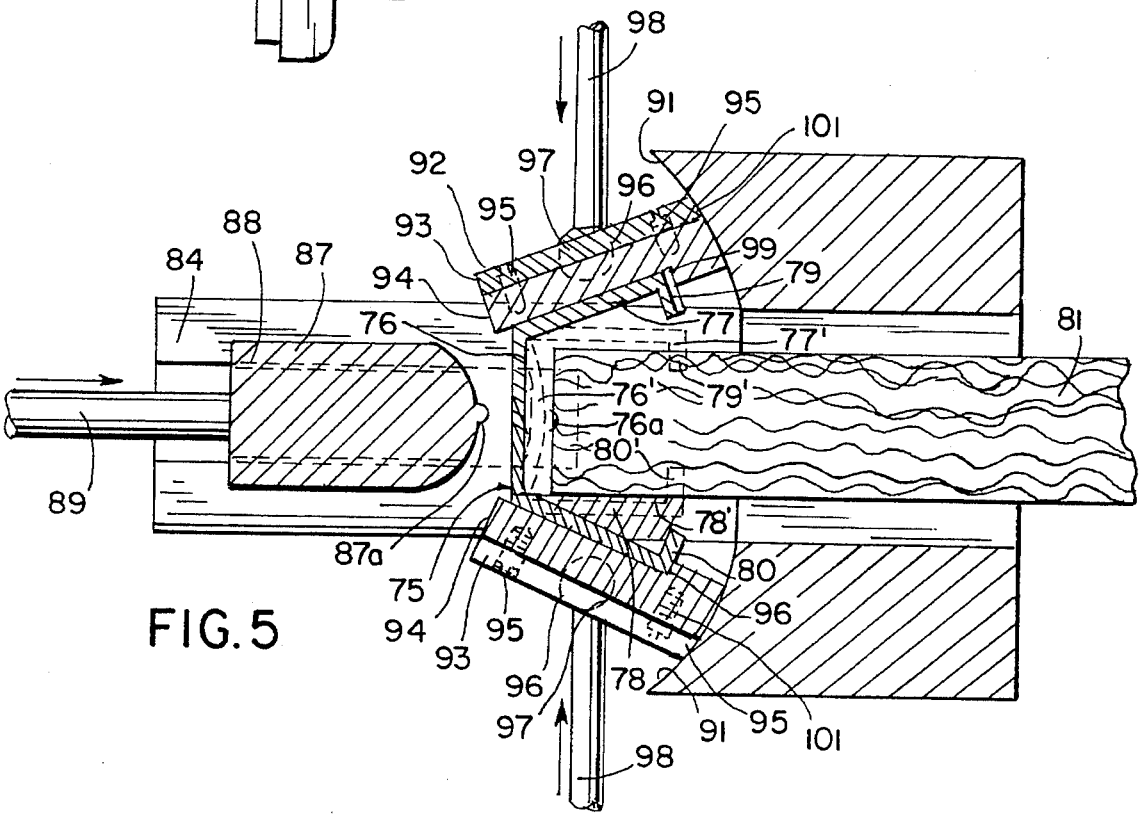
FIG. 5 is a somewhat diagrammatic illustration of an apparatus for the performing of the method of the invention without utilizing the special form of holding member described herein.

FIG. 5 diagrammatically illustrates an apparatus for performing the method of the invention without utilizing a channel having a specially preformed web, such as was described in connection with the previous embodiments. In this alternative, the channel generally designated at 75 has a flat web 76, a pair of flanges 77 and 78 with subflanges 79 and 80 along the outer edges thereof. The apparatus for applying pressure to secure channel 75 to a filter body generally designated at 81, for example, is of such a nature that pressure is applied to web 76 to bend the web into a curve with a concave outer face having a stiffening rib 76*a* projecting from the web as well as to bend flanges 77 and 78 towards each other.

The apparatus illustrated comprises a pair of end members 84, on each of which is a slideway 85. A web pressure head 87 has a leading nib 87*a* and lands 88 across the ends thereof, which lands are received in ways 85 to guide the movement of the nibbed pressure head 87. Suitable power means (not shown) is attached to rod 89, which in turn is connected to nibbed pressure head 87 to supply the force to bend the web 76 and form rib 76*a*, as subsequently described. End members 84 have a pair of abutments 91 extending therebetween to resist the pressure of head 87 against the channel as will be described.

A pair of flange pressure heads 92 are each formed of two bars 93 and 94, fastened together by screws 95. Each has a socket 96 equally spaced in bars 93 and 94 to receive balls 97 on the end of rods 98. Suitable power means (not shown) are connected to piston rods 98 to apply opposing forces for the bending of the flanges toward each other. Each of bars 94 has an abutment 99 against which subflanges 79 and 80 of the channel 75 are pressed. Pressure heads 92 have curved ends 101 formed in the shape of a segment of a circle. Abutments 91 are correspondingly curved to guide the pressure heads 92 into position and resist the pressure applied to the web.

In this embodiment, pressure is applied to web 76 by means of nibbed head 87 to bend the original straight web into a curve and simultaneously form rib 76*a*, as illustrated at 76'. In addition, pressure is applied to flanges 77 and 78 by pressure heads 92 to bend the two flanges 77 and 78 together, with the two flanges assuming the position illustrated in dotted lines at 77' and 78'. When these pressures are released, the tendency of flanges 79 and 80 to separate as a result of the resiliency of the material of the channel is at least offset by the resiliency of the stressed and reinforced web 76', as above described with reference to the previously described embodiments of the invention.

While the invention has been described with reference to a preferred embodiment, those skilled in the art will appreciate that certain substitutions, alterations and omissions may be made without departing from the spirit thereof. For example, stiffening rib 76, 76*a* may project from either side of web 13 and more than one rib may be formed in any one web. Accordingly, the foregoing description is meant to be exemplary only and should not be deemed limitative on the scope of the invention set forth in the accompanying claims.

I claim:

1. A frame for a filter having two continuous sides terminating in an edge, said frame comprising:

a semi-resilient, deformable channel having an inwardly curved web with two piercing flanges extending from a convex side thereof, said curved web having at least one longitudinally extending, dimpled stiffening rib integrally formed on and projecting centrally from a surface of the web adjacent said edge, said rib enabling said flanges to be forcibly urged into continuous, piercing engagement with the sides of the filter.

2. The frame according to claim 1, wherein a series of said channels are positioned adjacent each other around the periphery of the filter.

3. The frame according to claim 2, wherein at least one end of at least one of said channels is provided with a bendable tongue deformable into an aperture formed in an adjacent channel to lock said channels together around the periphery of the filter.

4. The frame according to claim 2, wherein each of said channels is formed with complementary end portions.

5. A frame for a filter having two continuous sides terminating in an edge, said frame comprising:

a semi-resilient deformable channel having an inwardly curved web with two piercing flanges extending from a convex side thereof, said web subject to assuming an outwardly curved configuration depending on the stresses imposed thereon, said curved web having a longitudinally extending, dimpled stiffening means integrally formed on and projecting centrally and inwardly from a surface of the web to a position immediately adjacent said edge of said filter for preventing said inwardly curved web from assuming said outwardly curved configuration.

6. The frame according to claim 5, wherein each of said two flanges have a subflange engageable with a side of the filter.

* * * * *